United States Patent [19]

Scherer

[11] Patent Number: 5,029,453

[45] Date of Patent: Jul. 9, 1991

[54] CHANNEL BLOCK ICE SYSTEM

[76] Inventor: J. Stirling Scherer, 1021 Hill St., Ste. No. 5, Santa Monica, Calif. 90405

[21] Appl. No.: 521,181

[22] Filed: May 9, 1990

[51] Int. Cl.[5] ..... F25C 5/02

[52] U.S. Cl. ..... 62/320; 62/356

[58] Field of Search ..... 62/320, 348, 356, 347, 62/352; 425/308, 444, 445

[56] References Cited

U.S. PATENT DOCUMENTS

| | | | |
|---|---|---|---|
| 530,526 | 12/1894 | Holden | 62/320 |
| 990,590 | 4/1911 | Ray | 62/320 X |
| 1,921,549 | 8/1933 | Spaan | 62/160 |
| 1,947,740 | 2/1934 | Robinson | 62/320 X |
| 2,082,665 | 6/1937 | Uline | 62/356 X |
| 2,674,862 | 4/1954 | Nigro | 62/320 |
| 3,274,794 | 9/1966 | Wilbushewick | 62/356 X |
| 3,392,540 | 7/1968 | Council et al. | 62/352 X |
| 4,464,910 | 8/1984 | Stultz | 62/320 |

OTHER PUBLICATIONS

Jos. A. Martocello & Co., "Martocello Clear Raw Water Ice Systems and Supplies", 1931, pp. 47, 48, 49, 96, 133, Clinebell, 11-16 Block Ice Maker.

K. G. Brown Mfg., "New Block Ice Makers", Refrigeration, May 29, 1990.

Vivian of St. Louis "Ice Blocks for Carving Blocks", Refrigeration, Feb. 5, 1990.

*Primary Examiner*—William E. Tapolcai

*Attorney, Agent, or Firm*—Poms, Smith, Lande & Rose

[57] ABSTRACT

A channel block ice making system includes a plurality of elongated channels and an associated refrigeration system for supplying coolant to the walls of the channels to form long, heavy channel blocks of ice. Water is recirculated from one end of said channels to the other end thereof, and after the channel blocks of ice are solidly frozen, the excess water including salts and the like is drained off, the outer surfaces of the channel blocks of ice are warmed, and they are advanced so that the ends of the blocks of ice protrude from the ends of the channels, where standard size blocks of ice are cut off. Fins on the sides of the channels score the blocks of ice so that the standard size blocks may be later automatically broken into smaller blocks and packaged. A door or gate is provided for retaining water within the channels during the freezing process, and for permitting subsequent easy removal of the ice.

35 Claims, 5 Drawing Sheets

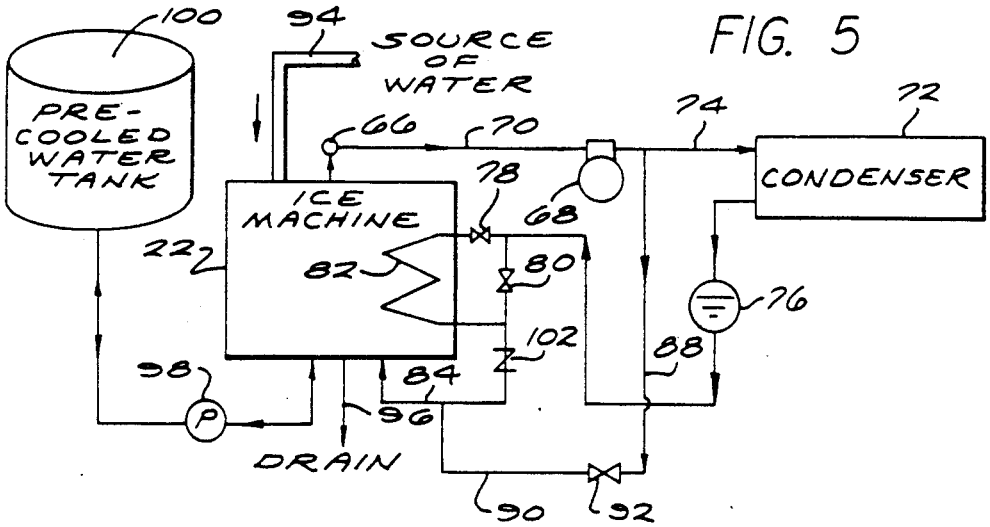
FIG. 5
FIG. 6
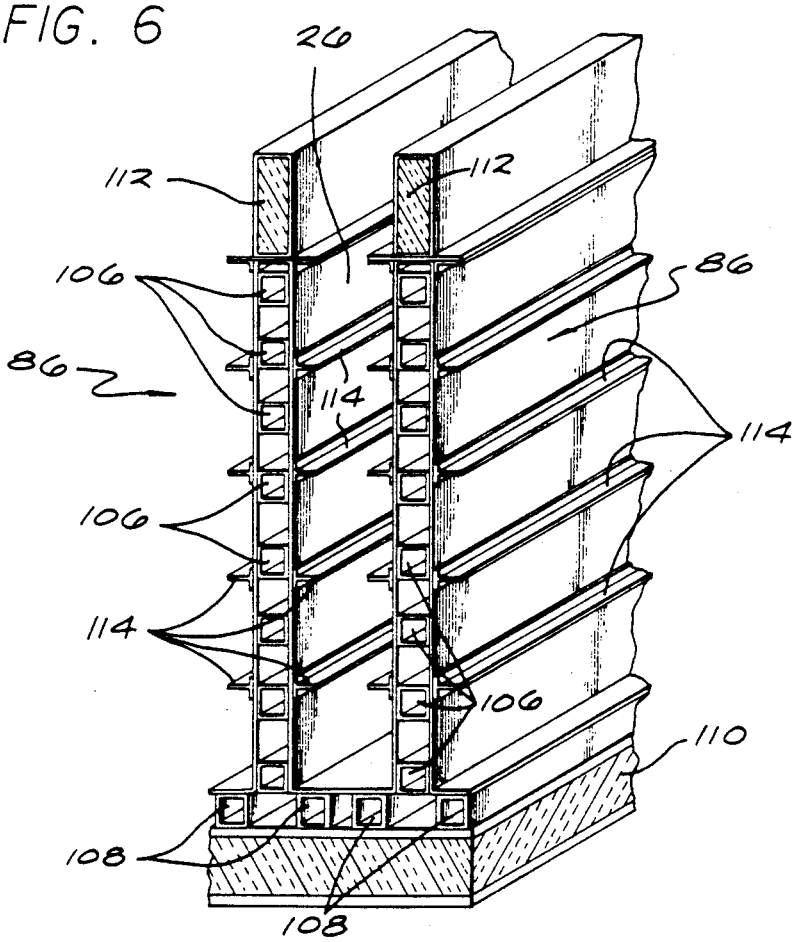

CHANNEL BLOCK ICE SYSTEM

FIELD OF THE INVENTION

This invention relates to an economical system for making blocks of ice.

BACKGROUND OF THE INVENTION

The existing methods of making blocks of ice typically employ an array of large cans which are filled with water, which is frozen to form large blocks of ice which typically might weigh about 300 pounds. The cans are normally principally immersed in large refrigerated brine tanks, with associated chemical, sanitary, and rust problems. The methods are labor intensive, as the pure water freezes first at the inner surface of the cans and water containing salts or the like remains liquid toward the center and upper portion of the can. This impure water solution is sucked out, and the space is filled with new water. This normally involves workmen walking and working over the surface of the array of cans, resulting in conditions which are not as sanitary as might be desired. Following freezing of the large blocks of ice in the cans, heavy duty hoisting arrangements are provided for raising groups of the cans. The large ice blocks are then removed from the cans, and often manually chopped into smaller blocks for sale. The overall systems which have been used heretofore, are very complex, and include a number of steps and an array of equipment not specifically mentioned hereinabove. A typical system of the type described above is shown and described in a book entitled "Martocello Clear Raw Water Ice Systems and Supplies" Copyright 1931, Jos. A. Martocello & Co., Philadelphia, Pa.

As mentioned above, systems of the type described above are labor intensive and have serious sanitary problems. Accordingly, a principal object of the present invention is to provide a simple ice block making system which avoids these problems.

Attention is also directed to H. J. Spain, U.S. Pat. No. 1,921,549, granted Aug. 8, 1933, and entitled "Apparatus for Manufacturing Ice in Plates". This patent discloses manufacturing ice in plates, but would still require heavy-duty lifting arrangements to raise the huge plates, as well as other shortcomings.

A further object of the invention is to provide an ice block making machine which does not require the lifting of large blocks of heavy ice.

SUMMARY OF THE INVENTION

In accordance with an illustrative preferred embodiment of the present invention, long channels are provided for forming very large long heavy channel blocks of ice, and the walls of the channels are cooled with refrigerant. Water is circulated through the channels in parallel, through an external path, and impurities or salts in the water remain in the external path after the long channels are frozen solid, forming channel blocks of pure ice. The water is then drained, and a large sealing gate at the output or harvest end of the channels is opened. Heat is supplied to the walls of the channels to loosen the very large, long channel blocks of ice; and a harvest bar is advanced to move all of the long channel blocks of ice toward the outlet end of the system. A chain saw is then advanced across the ends of the channels, cutting off standard size blocks of ice from the long channel blocks. The harvest bar is successively advanced by increments and the blocks cut off, until the entire long channel blocks of ice have been cut into smaller, standard sized blocks of ice.

The system may then be refilled with water, and the cycle repeated.

In accordance with one aspect of the invention, a "pre-cooled water" tank may be provided; and the heating of the surfaces of the channel blocks of ice may be speeded up by filling the unit with new warmer water, after the cold water which has the salts and other impurities have been drained, when the channel blocks of ice have frozen solid. The new water, which might have a temperature of about 55 degrees F., or other temperature well above freezing, assists in warming the outer surfaces of the channel blocks of ice so that they may be easily advanced by the harvest bar and associated "dogs" extending down into each of the channels. Once the outer surfaces of the channel ice blocks have been warmed, and harvesting is in order, the cooled new water is pumped into the pre-cooled water tank for use in the next cycle, once the cutting of the channel ice blocks is completed. This step reduces the cost of cooling the water during the next freezing cycle.

In accordance with another feature of the invention, each of the long channels may be provided with inwardly extending fixed fins for pre-scoring or notching the channel ice blocks which are cut off into standard size ice blocks by the chain saw, to facilitate later dividing of the standard ice blocks into smaller nominal ten pound blocks for retail sale or final use.

As an additional feature of the invention, an output slide or conveyor from the chain saw may direct the standard size blocks down a ramp to a conveyor and automatic block breaking mechanism which separates the smaller ten pound blocks from the larger standard size blocks along the score lines provided by the channel fins mentioned above.

The circulation of water, and resultant agitation produces clear, mineral-free ice. For some purposes, where white ice is preferred, or to save costs, circulation could be eliminated. If desired or needed, supplemental filtration or treatment of the water may be used.

Among the many advantages of the system of the present invention are the following:

1. The system is virtually automatic, and essentially no manual labor is required.

2. The ice blocks are clear and pure, with substantially no impurities, as they are removed with the drain water.

3. No heavy hoisting or lifting is required as the long heavy bars of ice are automatically advanced and cut into a series of medium sized blocks, which may then be automatically broken into smaller 10 or 12 pound blocks.

4. The use of a pre-cooled water tank as discussed above, reduces coolant power costs, and speeds up freezing.

5. The cost of a channel block ice system is a fraction of the cost of the old can and brine type ice-making systems.

6. The energy and labor costs for operating a channel block system are significantly lower than those required for the old type of system.

In passing, to give a general idea of the size of a representative system, the channels could be about 40 feet long, six inches wide, and 30 inches deep, and the long, heavy channel blocks of ice would each weigh more than a ton. Using a 10 or 12 channel system and two freezing cycles per day, the system would produce more than 20 tons of pure block ice of nominal 10 pound block size, each day.

Other objects, features, and advantages will become apparent from a consideration of the following detailed description, and from the accompanying drawings.

BRIEF DESCRIPTION OF THE DRAWINGS

FIG. 5 shows a system illustrating the present invention, with emphasis on the refrigeration aspects of the system;

FIG. 6 is an enlarged schematic cross-sectional view of one of the channels, together with the associated walls of the channels with arrangements for circulating refrigerant through the walls;

DETAILED DESCRIPTION OF PREFERRED EMBODIMENT

Figure 4:
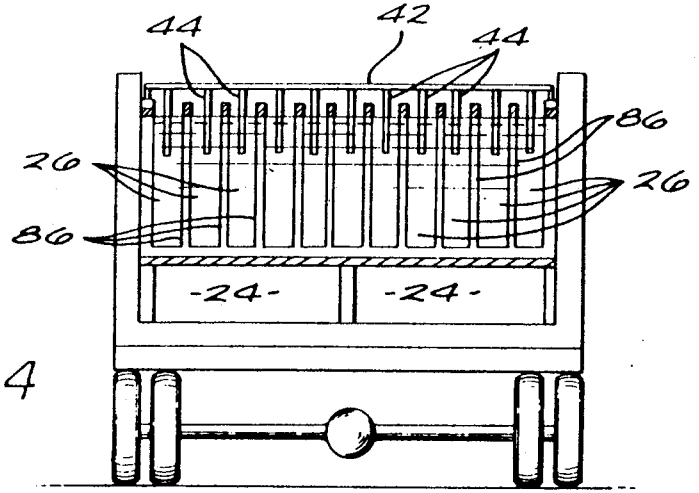
FIG. 4 is a schematic view partially taken along lines 4—4 of FIG. 2 and showing how the system might be mounted as or on a trailer.
Figure 1:
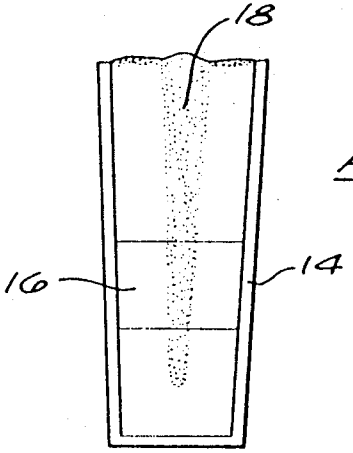
FIG. 1 PRIOR ART
FIG. 1 is a diagrammatic showing of prior art ice block formation, showing the central core including unfrozen salts and other impurities.

Referring now to the drawings, FIG. 1 shows an intermediate stage in the formation of ice blocks in accordance with the prior art. In the prior art systems, a large number of cans, such as the can 14, have their outer surfaces exposed to refrigerant, such as brine, so that the water with which the can 14 is filled, freezes, as indicated at reference numeral 16. However, commercially available water normally includes certain impurities and salts, and these tend to accumulate in a central core 18, remaining in solution as pure ice is formed at the walls of the can 14. As a step in the formation of ice blocks, the solution including salts and other impurities, as indicated at 18 in FIG. 1, is sucked out of the core, using a small tube or pipe, and fresh water is supplied to this core space. As mentioned above, this step requires manual attention and is labor-intensive. In addition, sanitary problems arise as the worker's must walk across arrays of cans, such as the can 14, in the course of removing the solution indicated at reference numeral 18, and refilling this core with fresh water.

Figure 2:
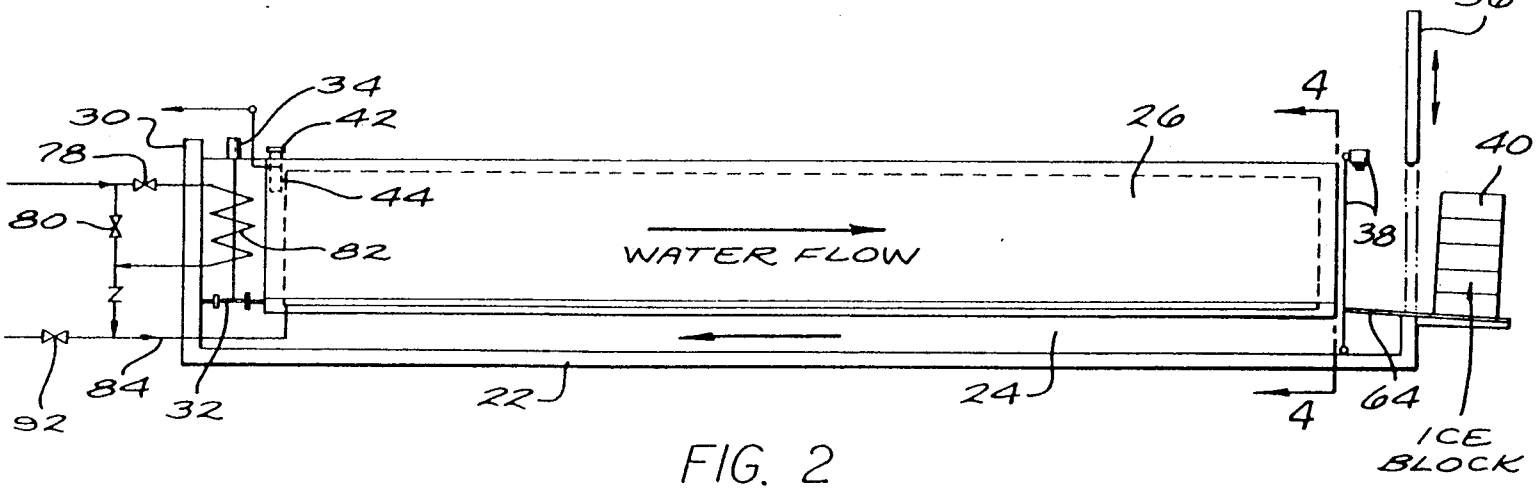
FIG. 2 is a diagrammatic side view of a channel ice block system illustrating the principles of the present invention.
Figure 3:
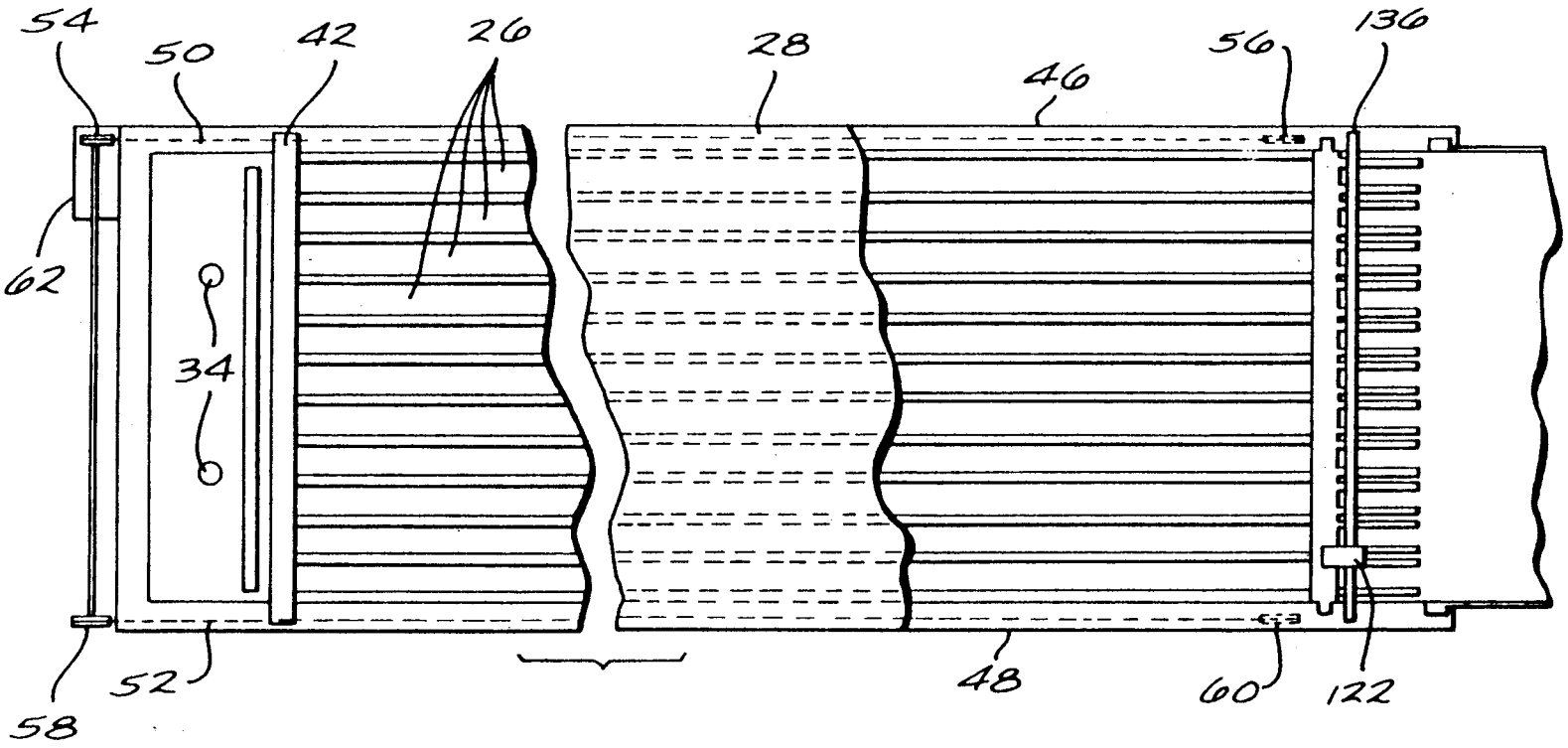
FIG. 3 is a top view of the channel ice block system of FIG. 2.

To avoid the problems discussed hereinabove in connection with the prior art systems, the system as shown and described in connection with FIGS. 2 through 11 has been developed. FIG. 2 is a schematic overall side view of a system illustrating the present invention, with FIG. 3 being a top view of the system, and FIG. 4 being a partial cross-section taken along lines 4—4 of FIG. 2, and showing how the unit might be mounted as a trailer. Referring back to FIG. 2, the system includes a box-like, water-tight container or frame 22, with a water flow path including the lower return path 24, and the upper series of parallel channels 26 in which the long, heavy channel ice blocks are formed. The return path could be to one side or overhead, if desired. A cover 28 is shown schematically in FIG. 3, but is not included in the showings of FIGS. 2 and 4. At the input end 30 of the system are two pumps or circulators, including the circulating propeller blades 32 and the driving motors 34.

At the output end of the system, as shown to the right in FIG. 2, is a sealing gate 36 which may be raised or pivoted out of the way, when the long channel ice blocks have been frozen solid, and water has been drained from the return path 24. A chain saw 38 cuts off standard-sized, scored ice blocks as indicated at reference numeral 40, as they are advanced from left to right, as shown in FIG. 2, by the harvest bar 42 and the depending "dogs" 44 which engage the rear end of each of the long, heavy channel blocks formed in the parallel channels 26. The two outer ends of the harvest bar are mounted in guides extending along the upper surface of the side walls 46 and 48 of the system. Secured to the harvest bar 42 at its two ends are the chains 50 and 52 which are mounted on sprockets 54 and 56 for the chain 50, and sprockets 58 and 60 for the chain 52. The sprockets 54 and 58 at the input end of the system, are driven by a motor and suitable reduction gears included in the housing 62 as shown to the left in FIG. 3.

After the ice blocks 40 are cut off of the ends of the long, heavy channel ice blocks from the channels 26, at the right-hand end of the system, as shown in FIG. 2, they move to the right on the slide or conveyor 64 and are further processed, as shown in some of the later figures of the present drawings.

FIG. 5 is a showing of the refrigeration aspects of the present invention. Warm gaseous coolant from the ice machine is received at the suction vapor header or manifold 66 and is coupled to the compressor 68 via line or conduit 70. From the compressor 68, the coolant is applied to the condenser 72 through conduit or pipe 74. The liquid coolant is collected in the receiver 76 and is supplied to the ice machine 22 through the control and expansion valves 78 and 80. The pre-cooling coil 82 may be located at the input end of the channels, immersed in the water which is being directed through the channels by the pumps 32, 34, as shown in FIG. 2. The input line 84 directs the bulk of the refrigerant to conduits within the walls 86 which separate the channels 26.

After the channel blocks of ice have been completely frozen, and when it is desired to harvest the ice, warm refrigerant is supplied to the ice machine 22 through conduits 88 and 90 by the operation of the control valve 92. Similarly, the control valves 78 and 80 may be closed, to prevent the flow of cooling refrigerant. With warm refrigerant being directed through the walls 86 of the system, the surfaces of the channel ice blocks will warm sufficiently so that the harvest bar 42 and the associated dogs 44 may advance the channel ice blocks, as discussed hereinbelow.

Also shown diagrammatically in FIG. 5 is a source of fresh water 94, a drain 96, a pump 98, and a tank for pre-cooled water, designated by the reference numeral 100. An optional heat exchanger could be provided to cool incoming water from the drain water, chips of ice, and the like. As mentioned above, after the channel blocks of ice are fully formed and frozen, the water in the recirculation channel 24 and at the two ends of the apparatus is drained out, thereby disposing of the salts and impurities which are now included in this water. The recirculation channel 24, and the two ends of the machine, may then be filled with fresh water at an elevated temperature, such as 55 degrees F., to aid in the process of warming the outer surfaces of the channel blocks of ice. With the warmer water in the return channel 24 and at both ends of the apparatus, and warm refrigerant being circulated through the walls 86 between the channels containing the channel blocks of ice, the outer surfaces of the channel blocks of ice are soon warmed to a sufficiently high temperature, that the blocks can be slid along the channels to the output end of the system. When the surface temperature of the channel blocks of ice has reached this point, the water in the system is pumped by the pump 98 into the pre-cooled water tank 100. As can be appreciated, the temperature of the water will have been reduced significantly in the course of warming the outer surfaces of the channel blocks of ice, and this pre-cooled water is stored in the tank 100, for immediate use as soon as the block harvesting process is completed. Of course, by using pre-cooled water for the next cycle, substantial power costs which would otherwise be needed to cool fresh water, is saved.

Referring back to FIG. 2 of the drawings, the pump including the motors 34 and the propellers 32, generates a certain amount of heat, as the propellers are operating. Although this heat is relatively small, it is still desirable to provide the special cooling coil 82 at the input to the channels where the ice is to be formed, to more than overcome the heat generated by the pump, and to pre-cool the water flowing into the channels. The coil 82 may be of significant size, and may be chilled to the extent that a substantial layer of ice will build up on it. Then, at the start of the next subsequent cycle, when fresh water is brought into the system, the ice on the coil 82 will contribute to its pre-cooling.

Incidentally, returning to the pre-cooled water tank 100, as shown in FIG. 5, this is clearly an optional feature, and the system may be operated without the use of such a pre-cooled water tank, and merely using warmed refrigerant gas supplied to the walls 86 separating the channels 26 of the system, in order to warm the surfaces of the channel ice blocks to permit their movement along the channels for harvesting. Incidentally, the check valve 102 is provided to prevent the flow of the hot refrigerant gases up into the coil 82, as there is no need to melt ice which may be formed on this coil, which may be of use in the subsequent cooling cycle.

Referring now to FIG. 6 of the drawings, an enlarged showing is presented of a single channel 26, with two of the walls 86 on either side of it. Included within the walls 86 are rectangular conduits 106 through which the refrigerant from the input line 84 is circulated. Similarly, the conduits 108 carry refrigerant to the lower surfaces of the channels 26. Below the channels 26 and the conduits 108 is a layer of thermal insulating material 110 separating the channel area from the recirculation channel 24, as shown in FIG. 2. In addition, thermal insulating material 112 is provided at the upper surfaces and at the ends of the walls 86 which separate the channels 26.

Also shown in FIG. 6 are the fins 114 which serve to score the long channel ice blocks along their entire length, so that the standard size blocks can easily be sub-divided into nominal 10-pound blocks by an automatic process, as discussed hereinbelow.

Figure 7:
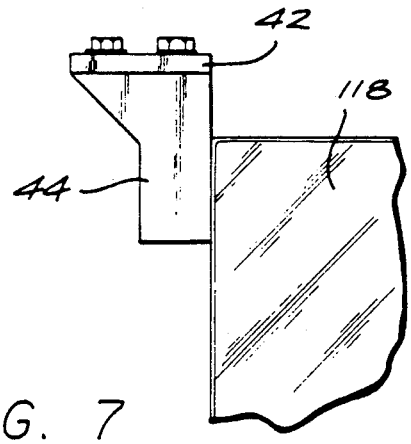
FIG. 7 is a schematic showing of the harvest bar, and one associated "dog" engaging the rear end of one of the channel ice blocks, in the course of advancing the channel ice block toward the harvest end of the system.

FIG. 7 is an enlarged showing of the harvest bar 42 and one of the "dogs" which extends downwardly from the harvest bar 42 to engage the upper rear corner of each of the channel ice blocks 118, when the channel ice blocks are being advanced.

Figure 8:
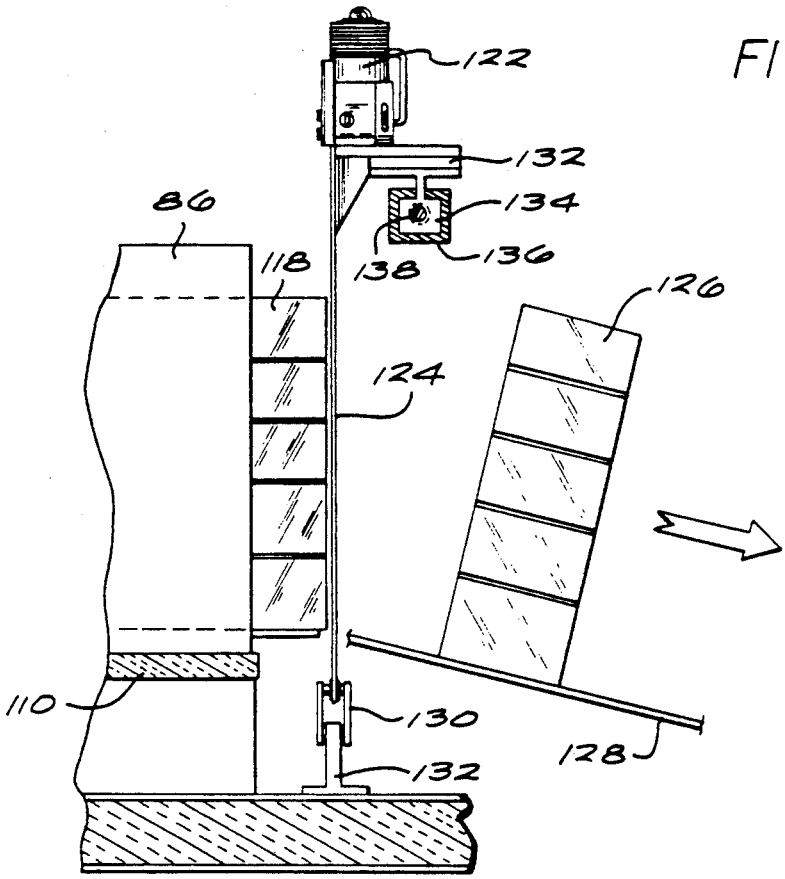
FIG. 8 is an enlarged showing of the output of the system showing a standard size ice block which has been cut off by a chain saw from one of the long, heavy channel ice blocks.

FIG. 8 is a diagrammatic showing of the output end of the channel ice block machine. More specifically, FIG. 8 shows a channel ice block 118 which has been advanced beyond the end of the walls 86 which separate the channels 26 from one another. In FIG. 8, the chain saw motor 122 drives the cutting saw chain 124, which is employed to cut off successive standard size blocks, such as the scored block 126 which is shown in FIG. 8 as sliding down the slanted slide 128. The chain saw is similar to that employed in cutting wood in that it has a long metal plate, around which the chain 124 extends. The lower end of the long metal plate is secured to a heavy guide member 130, which is guided in its transverse movement by the fixed T-shaped guide member 132. The chain saw motor 122 is mounted on a bracket 132 which in turn is mounted on an elongated slide 134 for longitudinal movement within the slide housing or track 136. Movement of the slide 134 in the slide housing or track 136 may be accomplished by rotating a large screw 138 which makes threaded engagement within the slider 134. As the screw 138 is rotated, the slider, bracket, and chain saw motor assembly 122 are moved transversely, across the output end of the channel ice block system, to cut off standard size blocks of ice, such as the block 126 when the saw assembly is moved in one direction, or when the screw 138 is rotated in the opposite direction, the chain saw assembly is shifted in the other direction to prepare for the next series of cuts through the ends of the advanced channel blocks of ice.

Figure 9:
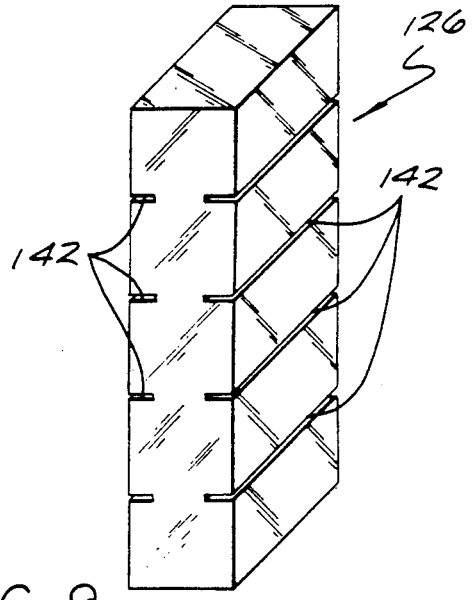
FIG. 9 is an enlarged isometric view of one of the standard size ice blocks, showing the score lines provided for breaking the block into smaller 10 or 12 pound blocks for retail sale, or use.

FIG. 9 is a perspective view of one of the standard size blocks of ice 126. The overall block of ice as shown in FIG. 9 is 6 inches wide by 10 inches in length, and 30 inches deep. It has a gross weight of approximately 60 pounds, and nominal net weight of 50 pounds, to accommodate various factors, such as chipping or melting of the ice. The score indentations 142 permit easy division of the block 126 into a number of smaller blocks, each having approximate size of 6 inches by 6 inches by 10 inches, and a gross weight of 12 pounds, and a nominal net weight of 10 pounds.

Figure 10:
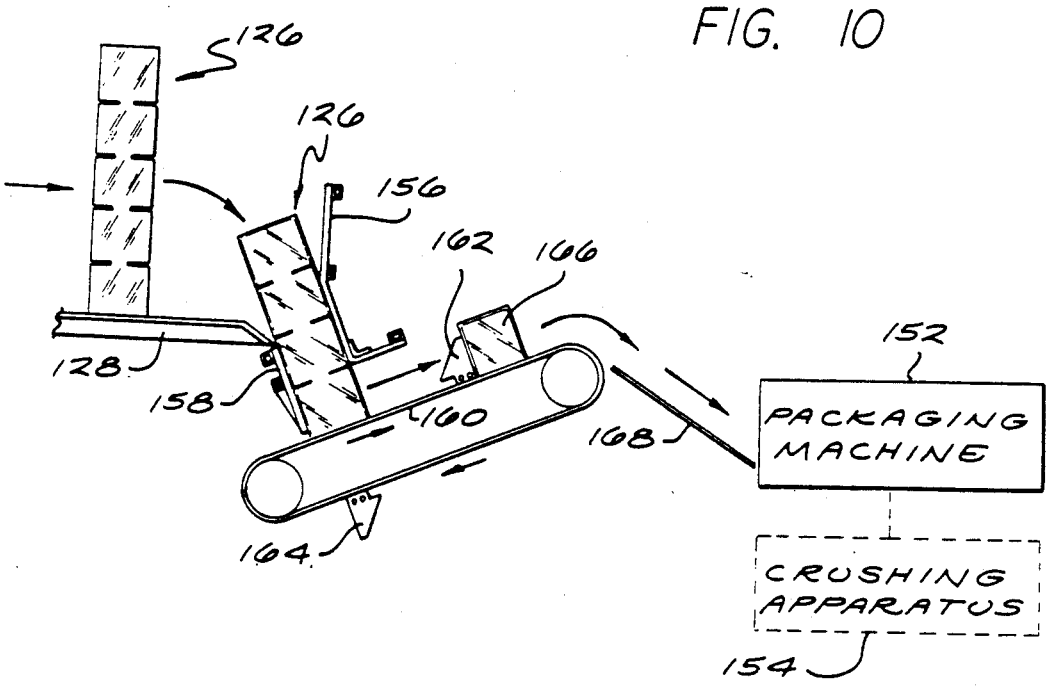
FIG. 10 is a diagrammatic showing of a conveyor and ice-breaking arrangement for successively breaking a smaller 10 or 12 pound blocks from the standard size scored blocks.
Figure 11:
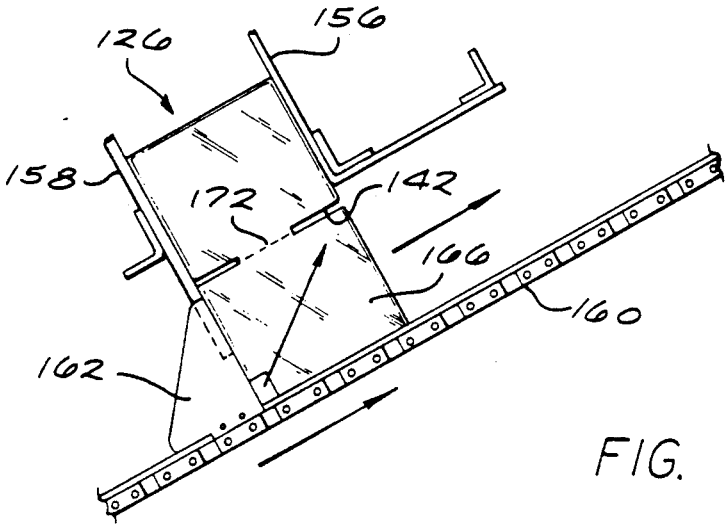
FIG. 11 is an enlarged diagrammatic showing of the block breaking portion of the apparatus shown in FIG. 10.

FIGS. 10 and 11 indicate schematically how the scored, standard size blocks 126 are initially broken into smaller 10-pound blocks and then are routed to a block packaging machine 152, or alternatively, to a crushing apparatus 154. Now, considering FIG. 10 in greater detail, the block 126 is directed from slide 128 to the chute including the guide members 156 and 158. The ice block then engages the heavy duty chain link conveyer 160. Secured to the conveyer are the impact members 162 and 164, which rotate with, and are secured to, the conveyer. With the ice block 126 being held in the chute, including the holding members 156 and 158, the impact members 162 and 164 break successive small 10 or 12 pound blocks of ice, such as the block 166, from the standard size block 126 and direct successive blocks down the slide 168 to the packaging machine 152 or the ice crushing apparatus 154.

FIG. 11 shows in a slightly enlarged drawing, the moment of impact of the impact member 162, on the scored standard size block 126, as the smaller block 166 is broken away. More specifically, it may be noted that the right-hand guide member 156 extends to a point just above the score line 142, so that the block 166 is free to move to the right on conveyer 160, after the impact from the breaking member 162 severs the lowermost small block 166 from the remainder of the block 126, along the dashed line 172.

Concerning dimensions of the apparatus, one representative set of dimensions includes channels which are 6 inches wide, 30 inches deep, and 36 feet long. The entire system including eleven parallel channels, and including the output gate and cut-off arrangements but not the block breaking equipment of FIGS. 10 and 11, would be approximately eight feet wide and 40 feet long. The standard size blocks formed by the machine would be 6 inches wide by 10 inches long by 30 inches deep.

The present invention could also be adapted to make other size blocks, such as the 300 pound blocks which have been another "standard" in the industry, and which were wide by 22" long by 45" deep. The channels would then be 45" deep and 11" wide and the channel ice blocks would be cut off at 22" intervals. In general, however, it is contemplated that the channels would normally be in the order of 20 feet long or longer, and 20 or more inches deep, although smaller dimensions could be used. For example, using 5" wide channels, significant productivity increases could be achieved.

In conclusion, it is to be understood that the foregoing detailed description and the accompanying drawings merely show one illustrative preferred embodiment of the invention. Changes and alternative arrangements may be employed without departing from the spirit and scope of the invention. Thus, by way of example and not of limitation, the size of the blocks formed in the channel ice-making machine may be varied, by changing the cross-section of the channels, and/or the intervals at which the chain saw cuts off the standard size blocks. The walls of the channels may be formed of evaporator panels or plates, instead of having walls with coils behind them. Other methods for refrigerating the walls of the channels may also be used. Instead of recirculating the water from the output end of the system to the input end of the system beneath the channels, the return flow path could be to one or both sides of the channels where the ice is formed. Concerning the refrigeration system, a simple compression-type system has been disclosed, but other refrigeration systems, including absorption-type systems could also be used. The gate at the output harvest end of the system has been shown being raised vertically, but a hinged output gate or door, with appropriate watertight arrangements, could also be employed. Also, various mechanical or manual alternatives may be used instead of the particular arrangements for mounting the harvest bar and associated dogs, and the chain saw, for specific examples. Alternative known refrigeration, hydraulic, and mechanical arrangements such as a different type of saw or several saws, may be substituted for those shown in the present drawings and described hereinabove, for accomplishing the same purposes. Concerning the mobile unit of FIG. 4, a refrigeration system may be mounted on the trailer. It is further noted that white ice blocks for making snow or producing icing may be made by eliminating the water circulation. The geometry of the system lends itself well to continuous filtering; thus, the system includes a single body of water which may be filtered continuously throughout the freezing cycle, with the filtering arrangements associated with the return path, and the effectiveness of the filtering increasing as the minerals and impurities are concentrated by the freezing process. The blocks could be of any desired shape, for example tapered or with protruding ribs, or having curved walls, in order to provide spacing to avoid freezing blocks together, or for any other desired result. Concerning the output configuration of the system with reference to FIGS. 8 through 10, an alternative arrangement could use a transverse conveyor at the output of the system as shown in FIG. 8, extending into the paper, as shown in this Figure, with the "dogs" of the type shown at 162 in FIG. 11, breaking off successive smaller blocks. Alternatively, the blocks 126 may be stored as they come out of the apparatus and later subdivided, either manually or automatically by suitable impact mechanisms. Accordingly, the present invention is not limited to the specific design shown in the drawings and described hereinabove.

What is claimed is:

1. A channel block ice system comprising:

means for providing a plurality of elongated channels for holding long heavy channel blocks of ice, said channels having side walls, said channels being at least twenty feet long and at least twenty inches deep;

means for circulating water through said elongated channels, including a return water conduit for circulating water from one end to the other end of said channels;

each channel being provided with a plurality of fins extending into said channels from the sides thereof to score said channel blocks of ice to facilitate subsequent subdivision into small blocks of ice;

means for supplying refrigerant to the inner surfaces of said channels for freezing water in said channels to form said channel blocks of ice;

means for advancing said channel blocks of ice along said channels so that the ends of said channel blocks of ice extend beyond said channels; and means for cutting off the extending ends of said long, heavy channel blocks of ice to form standard size blocks of ice.

2. A system as defined in claim 1 further comprising means for automatically subdividing said standard size ice blocks into smaller blocks of ice.

3. A system as defined in claim 1 wherein said means for cutting off blocks of ice is a chain saw.

4. A system as defined in claim 1 further comprising a watertight gate at the output end of said channels for alternatively retaining water in said channels or permitting the removal of the blocks of ice.

5. A system as defined in claim 1 wherein said channels are approximately 30 inches deep and approximately 6 inches wide, and wherein said fins are spaced approximately 6 inches apart.

6. A system as defined in claim 2 wherein means are provided for packaging said smaller blocks of ice.

7. A channel block ice system comprising:

means for providing a plurality of elongated channels for holding long heavy channel blocks of ice, said channels having side walls; said channels being at least partially open at the top;

means for circulating water through said elongated channels;

means for supplying refrigerant to the inner surfaces of said channels for freezing water in said channels to form said channel blocks of ice;

means for advancing said channel blocks of ice along said channels so that the ends of said blocks extend beyond said channels; and means for cutting off the extending ends of said long, heavy channel blocks of ice to form reduced size blocks of ice.

8. A system as defined in claim 7 wherein said channels are at least twenty feet long and are at least twenty inches deep.

9. A system as defined in claim 7 wherein said means for cutting off blocks of ice is a chain saw.

10. A system as defined in claim 7 further comprising a watertight gate at the output end of said channels for alternatively retaining water in said channels or permitting the removal of the blocks of ice.

11. A system as defined in claim 7 further comprising a cooling coil mounted adjacent the input end of said channels; means for supplying refrigerant to said cooling coil; and said system including means for circulating water to said channels past said cooling coil.

12. A channel block ice system comprising:

means for providing a plurality of elongated channels for holding long, heavy channel blocks of ice, said channels having side walls; said channels being at least partially open at the top;

means for circulating water through said elongated channels;

means for supplying refrigerant to the inner surfaces of said channels for freezing water in said channels to form said channel blocks of ice; and means for advancing said channel blocks of ice along said channels and out the ends of said channels.

13. A channel block ice system comprising:

means for providing an elongated channel for holding a long, heavy channel block of ice, said channel having side walls; said channels being at least partially open at the top;

means for supplying refrigerant to the inner surfaces of said channel for freezing water in said channel to form said channel block of ice; and means including a door or gate at one end of said channel for selectively retaining water in said channel, or for permitting harvesting or extraction of said block.

14. A system as defined in claim 13 including a plurality of said channels located adjacent to one another.

15. A channel block ice system as defined in claim 13 further including means for circulating water through said channel.

16. A channel block ice system comprising:

means for providing a plurality of elongated channels for holding long heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels so that the ends of said bars extend beyond said channels;

means for cutting off the extending ends of said long, heavy channel blocks of ice to form reduced size blocks of ice; and a return water conduit for circulating water in parallel from one end to the other end of each of said channels.

17. A channel block ice system comprising:

means for providing a plurality of elongated channels for holding long heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels so that the ends of said bars extend beyond said channels;

means for cutting off the extending ends of said long, heavy channel blocks of ice to form reduced size blocks of ice; and each channel being provided with a plurality of fins extending into said channels from the sides thereof to score said channel blocks of ice to facilitate subsequent subdivision into small blocks of ice.

18. A channel block ice system comprising:

means for providing a plurality of elongated channels for holding long heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels so that the ends of said bars extend beyond said channels;

means for cutting off the extending ends of said long, heavy channel blocks of ice to form reduced size blocks of ice; and means for automatically subdividing said reduced size ice blocks into smaller blocks of ice.

19. A system as defined in claim 18 wherein said means for subdividing said ice blocks includes means for holding said reduced size blocks fixed against movement, with the exception of the lower end of said blocks, and means for impacting the lower end of said blocks from the side to break off smaller size blocks.

20. A channel block ice system comprising:

means for providing a plurality of elongated channels for holding long heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels so that the ends of said bars extend beyond said channels;

means for cutting off the extending ends of said long, heavy channel blocks of ice to form reduced size blocks of ice; and a tank for pre-cooled water having a capacity comparable to the water capacity of the rest of said system less the water capacity of said channels; and means for pumping water back and forth between said tank and the remainder of said system.

21. A channel block ice system comprising:

means for providing a plurality of elongated channels for holding long heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels so that the ends of said bars extend beyond said channels;

means for cutting off the extending ends of said long, heavy channel blocks of ice to form reduced size blocks of ice; and means for draining off the water in said system which has not been frozen to remove salts and other impurities from the system.

22. A channel block ice system comprising:

means for providing a plurality of elongated channels for holding long, heavy channel blocks of ice, said channels having side walls;

means for circulating water through said elongated channels;

means for supplying refrigerant to the inner surfaces of said channels for freezing water in said channels to form said channel blocks of ice; and means for advancing said channel blocks of ice along said channels and out the ends of said channels; and each said channel being provided with a plurality of fins extending into said channels from the sides thereof to score said channel blocks of ice to facilitate subsequent subdivision into small blocks of ice.

23. A system as defined in claim 22 further comprising means for cutting off the extended ends of the channel blocks of ice to form reduced size scored blocks of ice, and means for automatically subdividing said reduced size ice blocks into smaller blocks of ice along the scores.

24. A channel block ice system comprising:

means for providing an elongated channel for holding a long, heavy channel block of ice, said channel having side walls;

means for supplying refrigerant to the inner surfaces of said channel for freezing water in said channel to form said channel block of ice; and means including a door or gate at one end of said channel for selectively retaining water in said channel, or for permitting harvesting or extraction of said block; and said channel being provided with a plurality of fins extending into said channel from the sides thereof to score said channel block of ice to facilitate subsequent subdivision into small blocks of ice.

25. A system as defined in claim 24 further comprising means for cutting off the extended end of the channel block of ice to form reduced size scored blocks of ice, and means for automatically subdividing said reduced size ice block into smaller blocks of ice along the scores.

26. A system as defined in claim 25 wherein said means for subdividing said reduced size scored blocks includes means for impacting the end of said blocks to separate successive smaller blocks of ice along said scopes.

27. A system as defined in claim 26 wherein said impacting means includes fixed elements or dogs secured to a conveyor.

28. A channel block ice system comprising:

means for providing a plurality of elongated channels for holding long heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels so that the ends of said bars extend beyond said channels;

means for cutting off the extending ends of said long, heavy channel blocks of ice to form reduced size blocks of ice; and means for transporting said system from one location to another.

29. A channel block ice system comprising:

means for providing a plurality of elongated channels for holding long, heavy channel blocks of ice, said channels having side walls;

means for circulating water through said elongated channels;

means for supplying refrigerant to the inner surfaces of said channels for freezing water in said channels to form said channel blocks of ice;

means for advancing said channel blocks of ice along said channels and out the ends of said channels; and means for transporting said system from one location to another.

30. A channel block ice system comprising:

means for providing an elongated channel for holding a long, heavy channel block of ice, said channel having side walls;

means for supplying refrigerant to the inner surfaces of said channel for freezing water in said channel to form said channel block of ice;

means including a door or gate at one end of said channel for selectively retaining water in said channel, or for permitting harvesting or extraction of said block; and means for transporting said system from one location to another.

31. A channel block ice system comprising:

means for providing an elongated channel for holding a long, heavy integral channel block of ice, said channel having side walls;

means for supplying refrigerant to the inner surfaces of said channel for freezing water in said channel to form said long, heavy, integral channel block of ice;

means including a door or gate at one end of said channel for selectively retaining water in said channel, or for permitting harvesting or extraction of said block;

said channel being at least 5 inches wide and at least 20 inches deep; and said channel being at least partially open at the top.

32. A channel block ice system as defined in claim 31 wherein said channel is at least 20 feet long.

33. A channel block ice system as defined in claim 31 wherein said system includes a plurality of channels as defined in claim 31, said channels being mounted substantially side-by-side with one another.

34. A channel block ice system comprising:

means for providing an elongated channel for holding a long, heavy integral channel block of ice, said channel having side walls;

means for supplying refrigerant to the inner surfaces of said channel for freezing water in said channel to form said long, heavy, integral channel block of ice;

means including a door or gate at one end of said channel for selectively retaining water in said channel, or for permitting harvesting or extraction of said block;

said channel being at least 2 inches wide and at least 20 inches deep, and at least six feet long; and said channel being at least partially open at the top.

35. A channel block ice system as defined in claim 34 wherein said system includes a plurality of channels as defined in claim 34, said channels being mounted substantially side-by-side with one another.

* * * * *